US010403207B2

(12) United States Patent
Kang et al.

(10) Patent No.: US 10,403,207 B2
(45) Date of Patent: Sep. 3, 2019

(54) DISPLAY DEVICE

(71) Applicant: Samsung Display Co., LTD., Yongin-si, Gyeonggi-Do (KR)

(72) Inventors: Jang-Mi Kang, Seoul (KR); Kyung-Hoon Kim, Uiwang-si (KR)

(73) Assignee: Samsung Display Co., Ltd. (KR)

( * ) Notice: Subject to any disclaimer, the term of this patent is extended or adjusted under 35 U.S.C. 154(b) by 38 days.

(21) Appl. No.: 15/589,482

(22) Filed: May 8, 2017

(65) Prior Publication Data

US 2017/0345373 A1 Nov. 30, 2017

(30) Foreign Application Priority Data

May 25, 2016 (KR) ..... 10-2016-0064347

(51) Int. Cl.
*G09G 3/3266* (2016.01)
*G09G 3/3258* (2016.01)

(52) U.S. Cl.
CPC ..... *G09G 3/3258* (2013.01); *G09G 3/3266* (2013.01); *G09G 2300/0809* (2013.01); *G09G 2310/0291* (2013.01)

(58) Field of Classification Search
CPC . G09G 3/3266; G09G 3/3258; G02F 1/13454
See application file for complete search history.

(56) References Cited

U.S. PATENT DOCUMENTS 9,934,742 B2 * 4/2018 Yoshida ..... G09G 3/3677
2013/0321499 A1 * 12/2013 Park ..... G09G 3/20 345/698
2014/0078123 A1 * 3/2014 Park ..... G09G 3/20 345/205
2015/0312635 A1 10/2015 Charania et al.

FOREIGN PATENT DOCUMENTS

KR 10-2011-0114266 A 10/2011
KR 10-2014-0037655 A 3/2014
KR 10-2017-0026889 3/2017

* cited by examiner

*Primary Examiner* — Xuemei Zheng
(74) *Attorney, Agent, or Firm* — Innovation Counsel LLP

(57) ABSTRACT

A display device includes a plurality of pixel circuits and a gate driver including a plurality of stages configured to output a gate signal to a plurality of gate lines, respectively, to provide the gate signal to the pixel circuits. Each of the stages is divided into a plurality of sub-blocks. At least one of the pixel circuits is located between two adjacent sub-blocks of the sub-blocks.

18 Claims, 16 Drawing Sheets

DISPLAY DEVICE

CROSS REFERENCE TO RELATED APPLICATION

This application claims priority under 35 U.S.C. § 119 to Korean patent Application No. 10-2016-0064347 filed on May 25, 2016, the disclosure of which is hereby incorporated by reference herein in its entirety.

BACKGROUND

1. Technical Field

Example embodiments of the inventive concept relate to a display device. More particularly, example embodiments of the inventive concept relate to a display device having a gate driver located in a display region in which pixel circuits are arranged.

2. Description of the Related Art

Generally, the display device includes a plurality of pixel circuits arranged in a matrix form in a display region. In addition, the display device further includes a gate driver providing a gate signal to the pixel circuits via gate lines and a data driver providing a data signal to the pixel circuits via the data lines.

Because the gate driver and the data driver of the display device are located in a non-display region outside of the display region, a size of the non-display region may increase as a size or a resolution of the display device increases.

SUMMARY

Example embodiments provide a display device capable of minimizing a size of the non-display region.

According to some example embodiments, a display device may include a plurality of pixel circuits and a gate driver including a plurality of stages configured to output a gate signal to a plurality of gate lines, respectively, to provide the gate signal to the pixel circuits. Each of the stages may be divided into a plurality of sub-blocks. At least one of the pixel circuits may be located between two adjacent sub-blocks of the sub-blocks.

In example embodiments, the pixel circuits may be arranged in a first direction and a second direction crossing the first direction. The gate lines may extend in the first direction. At least one of the sub-blocks may be configured to receive a clock signal from at least one vertical clock line extending in the second direction. At least one of the sub-blocks may be configured to receive a gate voltage from at least one voltage line extending in the second direction.

In example embodiments, each of the stages may include first, second, third, fourth and fifth sub-blocks sequentially arranged in a first direction. The third sub-block may be configured to receive a previous gate signal from one of previous stages or a vertical start signal as an input signal and control a first node and a second node in response to a first clock signal. The fourth sub-block may be located between the first node and a third node to decrease a voltage of the first node. The fifth sub-block may be configured to control the gate signal as a first logic level or a second logic level in response to a voltage of the second node and a voltage of the third node. The first sub-block may be configured to maintain the voltage of the second node as the first logic level in response to the first clock signal. The second sub-block may be configured to stabilize the gate signal in response to the voltage of the second node and a second clock signal.

In example embodiments, the first sub-block may include a holding transistor including a gate electrode configured to receive the first clock signal, a first electrode configured to receive a first gate voltage from a first vertical voltage line, and a second electrode connected to the second node, and a first capacitor including a first electrode connected to the second node and a second electrode configured to receive a second gate voltage from a second vertical voltage line.

In example embodiments, the second sub-block may include a first stabilizing transistor including a gate electrode connected to the second node, a first electrode configured to receive a second gate voltage from a second vertical voltage line, and a second electrode and a second stabilizing transistor including a gate electrode configured to receive the second clock signal, a first electrode connected to the second electrode of the first stabilizing transistor, and a second electrode connected to the first node.

In example embodiments, the third sub-block may include a first input transistor including a gate electrode configured to receive the first clock signal, a first electrode configured to receive the input signal, and a second electrode connected to the first node, and a second input transistor including a gate electrode connected to the first node, a first electrode configured to receive the first clock signal, and a second electrode connected to the second node.

In example embodiments, the fourth sub-block may include a reducing transistor including a gate electrode configured to receive a first gate voltage from a third voltage line, a first electrode connected to the first node, and a second electrode connected to the third node.

In example embodiments, the fifth sub-block may include a first output transistor including a gate electrode connected to the third node, a first electrode configured to receive a second clock signal, and a second electrode connected to a first output terminal to which the gate signal is outputted, a second capacitor including a first electrode connected to the third node and a second electrode connected to the first output terminal, and a second output transistor including a gate electrode connected to the second node, a first electrode configured to receive a second gate voltage from a fourth vertical voltage line, and a second electrode connected to the first output terminal.

In example embodiments, the second clock signal may be provided to the second sub-block and the fifth sub-block via different vertical clock lines.

In example embodiments, each of the stages further may include a sixth sub-block. The sixth sub-block may include a third output transistor including a gate electrode connected to the third node, a first electrode configured to receive the second clock signal, and a second electrode connected to a second output terminal to which the gate signal is outputted and a third capacitor including a first electrode connected to the third node and a second electrode connected to the second output terminal.

In example embodiments, at least one of the gate lines may be connected to a first pixel circuit and a second pixel circuit adjacent to the first pixel circuit in the second direction.

In example embodiments, the voltage line may be connected to the pixel circuits.

According to some example embodiments, a display device may include a plurality of pixel circuits arranged in a plurality of pixel rows extending in a first direction and a plurality of pixel columns extending in a second direction crossing the first direction, and a gate driver including a plurality of stages configured to output a gate signal to a plurality of gate lines extending in the first direction, respectively, to provide the gate signal to the pixel circuits. The stages are located between a first pixel column and a second pixel column different from the first pixel column of the pixel columns. Each of the stages may be disposed corresponding to at least two pixel rows of the pixel rows.

In example embodiments, the stages may be configured to receive a clock signal from at least one vertical clock line extending in the second direction and receive a gate voltage from at least one voltage line extending in the second direction.

In example embodiments, each of the stages may be divided into a plurality of sub-blocks. At least one of the pixel circuits may be located between two adjacent sub-blocks of the sub-blocks.

In example embodiments, the gate driver may include a first gate driver configured to provide the gate signal to odd-number pixel rows and a second gate driver configured to provide the gate signal to even-number pixel rows.

In example embodiments, At least one of the pixel columns may be located between the first gate driver and the second driver.

In example embodiments, at least one of the gate lines may be connected to both of a first pixel row and a second pixel row adjacent to the first pixel row.

According to some example embodiments, a display device may include a plurality of pixel circuits arranged in a plurality of pixel rows extending in a first direction and a plurality of pixel columns extending in a second direction crossing the first direction, and a gate driver including a plurality of stages configured to output a gate signal to a plurality of gate lines extending in the first direction, respectively, to provide the gate signal to the pixel circuits. The stages may be located between a first pixel column and a second pixel column different from the first pixel column of the pixel columns. At least one of the gate lines may be connected to both of a first pixel row and a second pixel row adjacent to the first pixel row.

In example embodiments, a structure of a first pixel circuit included in the first pixel row may be different from a stricture of a second pixel circuit included in the second pixel row.

Therefore, a display device according to example embodiments includes a gate driver having a plurality of stages. Each of the stages is divided into a plurality of sub-blocks, and at least one of the pixel circuits is located between two adjacent sub-blocks. Accordingly, the gate driver of the display device is located in an active region or a display region in which pixel circuits are arranged, thereby minimizing the size of the non-display region and decreasing an overall size of the display device.

BRIEF DESCRIPTION OF THE DRAWINGS

Exemplary embodiments will be described more fully hereinafter with reference to the accompanying drawings, in which various embodiments are shown.

DESCRIPTION OF EMBODIMENTS

Exemplary embodiments will be described more fully hereinafter with reference to the accompanying drawings, in which various embodiments are shown.

Figure 1:
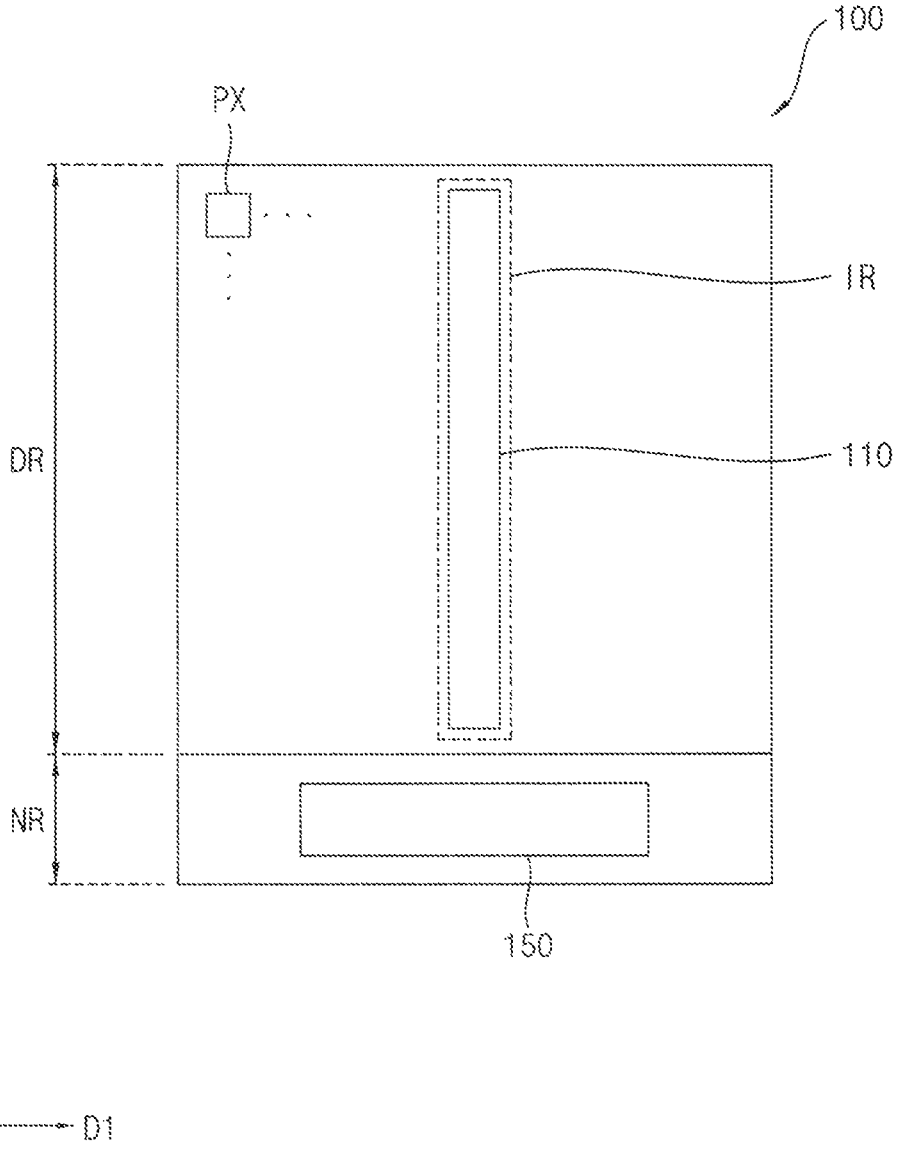
FIG. 1 is a block diagram illustrating a display device according to example embodiments.

FIG. 1 is a block diagram illustrating a display device according to one example embodiment.

Referring to FIG. 1, the display device 100 may be divided into a display region DR and a non-display region NR. A plurality of pixels PX and a gate driver 110 may be located in the display region DR. A data driver 150 may be located in the non-display region NR.

The pixel circuits PX may be arranged in a first direction D1 and a second direction D2 crossing the first direction D1. For example, the second direction D2 may be orthogonal to the first direction D1. The pixel circuit PX may receive a data signal from the data driver 150 via data lines and may receive a gate signal from the gate driver 110 via gate lines. The pixel circuits PX may display an image based on the data signal and the gate signal.

In one example embodiment, pixel circuits PX adjacent to each other in the second direction D2 may share some of the gate lines and transistors to secure a space in which the gate driver 100 is located within the circuit region IR of the display region DR. Hereinafter, a structure of the pixel circuit PX will be described in more detail with reference to the FIGS. 13 through 16.

The gate driver 110 may be located in the circuit region IR that corresponds to at least a portion of the display region DR. The gate driver 110 may include a plurality of stages outputting the gate signal to the plurality of gate lines, respectively, to provide the gate signal to the pixel circuits PX. Each of the stages may be divided into a plurality of sub-blocks. At least one pixel circuit PX may be located between two adjacent sub-blocks. Thus, split stages of the gate driver 100 may be inserted in a portion of the display region DR. The gate driver 110 may be simultaneously formed through the same manufacturing process as the pixel circuits PX.

In one example embodiment, the gate driver 110 may be placed in the center of the display region DR with respect to the first direction D1. In this case, because a distance between the gate driver 100 and the pixel circuits PX decreases in general, the time for charging or discharging the pixel circuit PX can be reduced. In another example embodiment, the gate driver 110 may be placed in or near the edge of the display region DR. In this case, some of the sub-blocks may be placed in the non-display region NR, and the others may be placed in the display region DR.

The data driver 150 may be located in the non-display region NR. The data driver 150 may provide the data signal to the pixel circuits PX. For example, the data driver 150 may be mounted on a substrate in which the pixel circuits PX and the gate driver 110 are formed using a chip-on-glass (COG) manner. In one example embodiment, the display device 100 may further include a timing controller providing driving control signals to the data driver 150 and the gate driver 110.

Although FIG. 1 shows that the circuit region IR is placed in the center of the display region DR with respect to the first direction D1, it is not limited thereto. For example, the circuit region IR may be placed in one edge of the display region DR or in two edges facing to each other of the display region DR.

Although the example embodiment of FIG. 1 shows that the data driver 150 is mounted on the display device 100 using the COG manner, the data driver may be connected to the display device using various manners. For example, the data driver may be connected to the display device using a chip-on-film (COF) manner, a tape carrier package (TCP) manner, etc. Thus, the display device may have various structures in which at least a portion of the gate driver is located in the display region.

Figure 2:
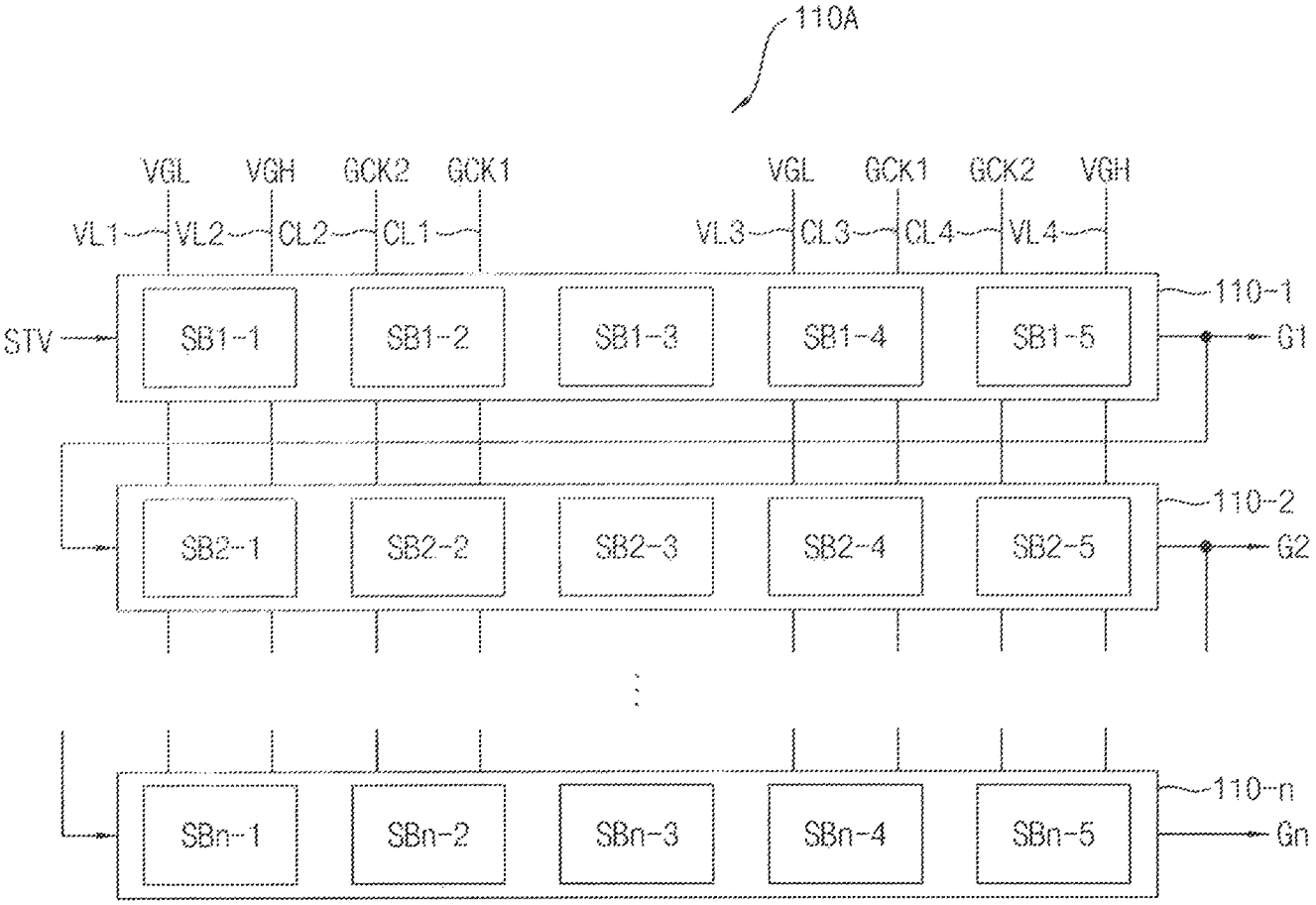
FIG. 2 is a block diagram illustrating one example of a gate driver included in a display device of FIG. 1.
Figure 3:
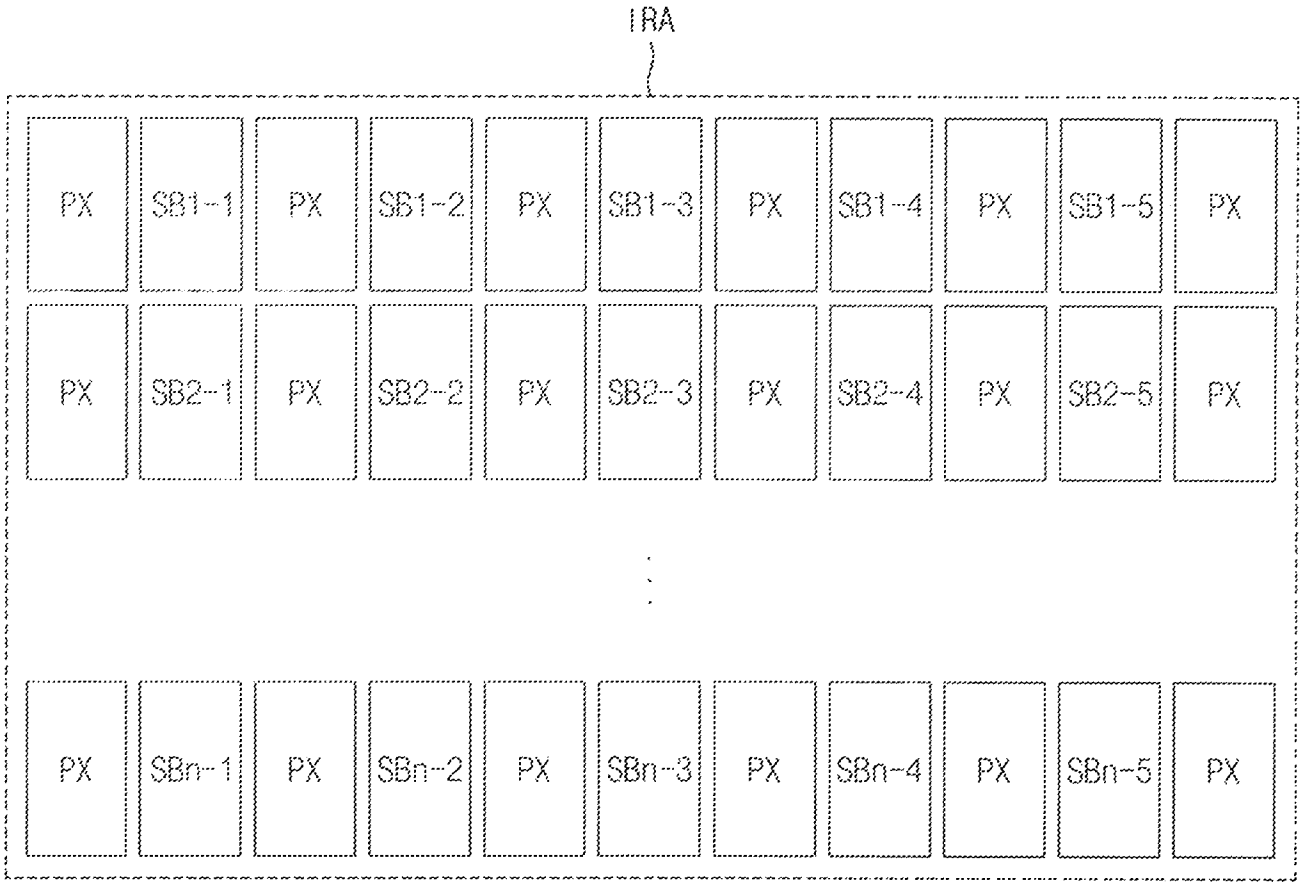
FIG. 3 is a diagram illustrating an example in which a gate driver of FIG. 2 is located in a display region.
Figure 4:
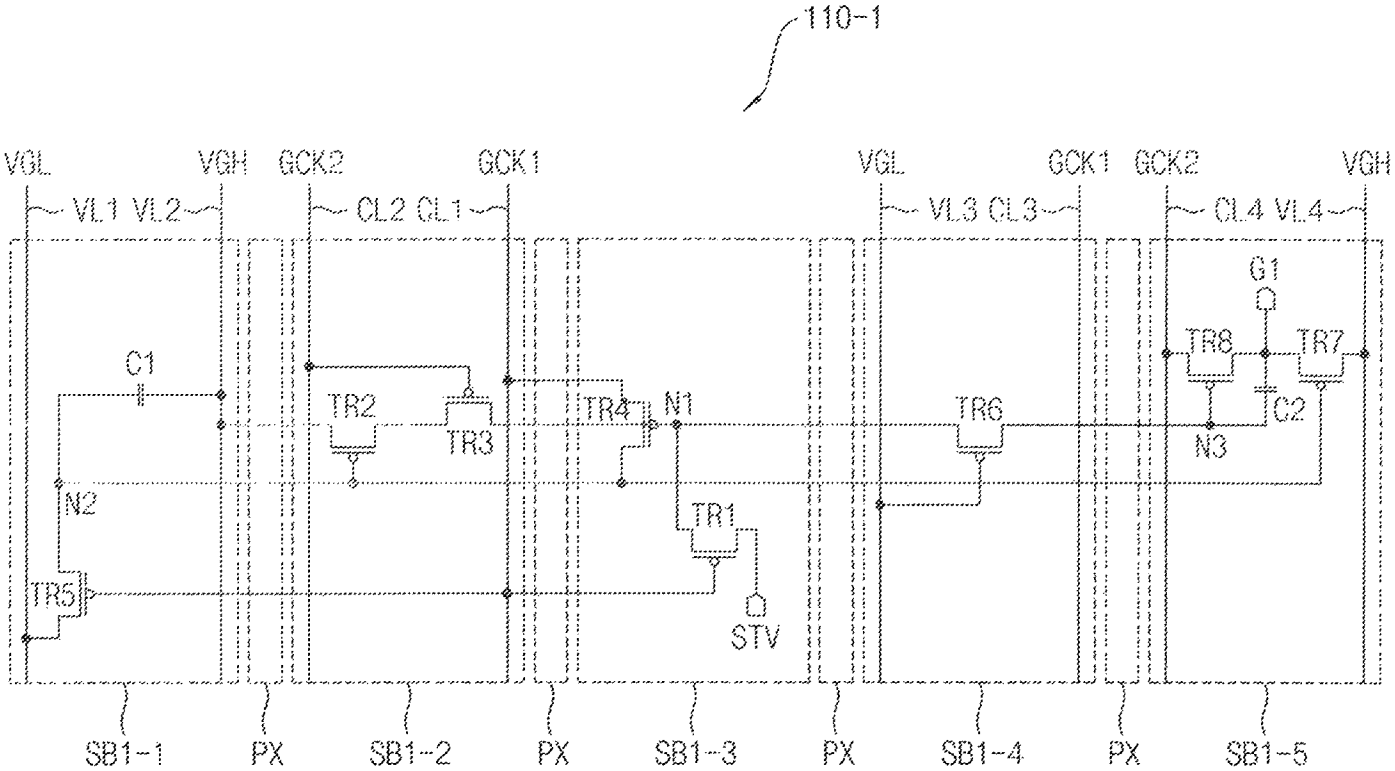
FIGS. 4 and 5 are circuit diagrams illustrating an example of stages included in a gate driver of FIG. 3.
Figure 5:
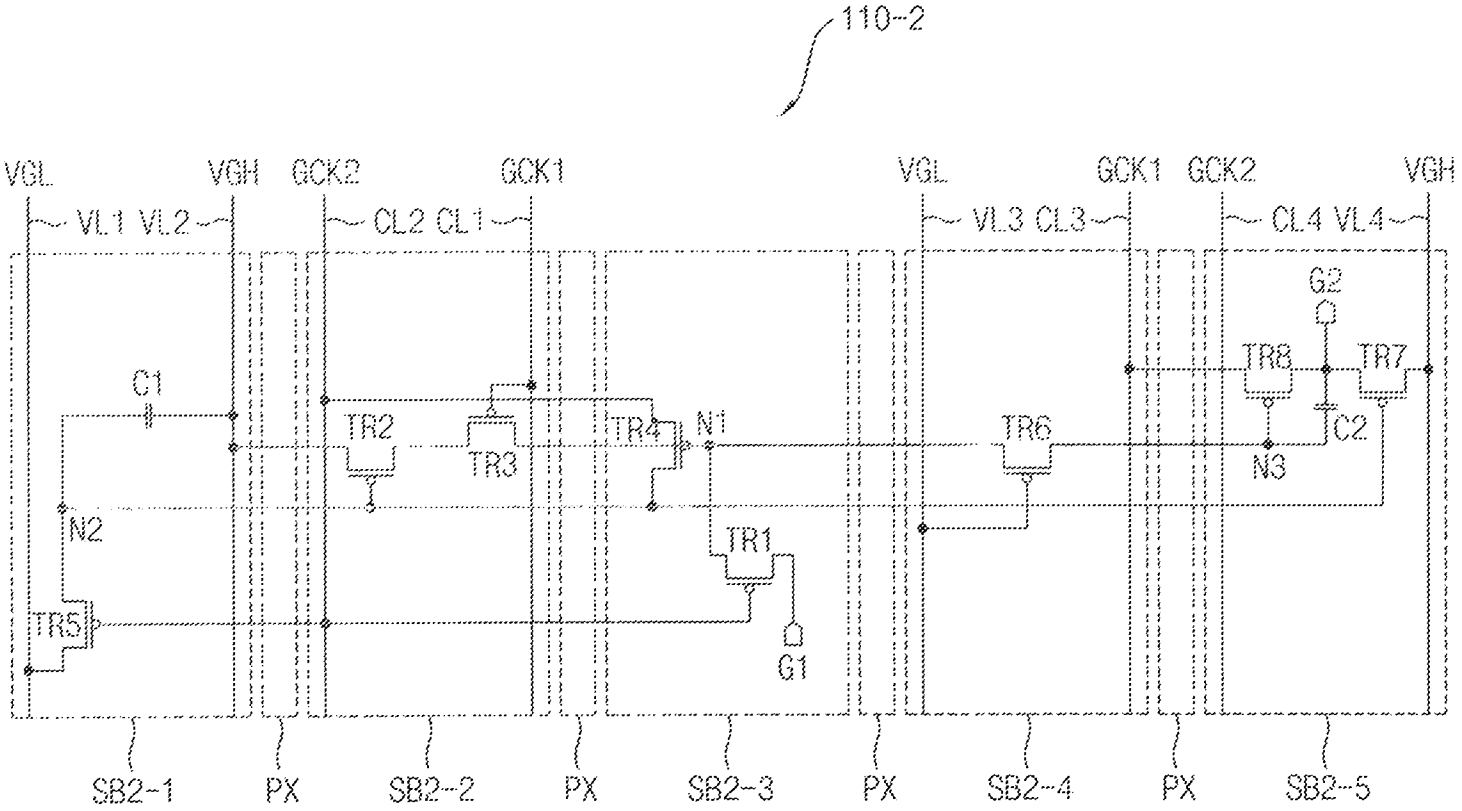

FIG. 2 is a block diagram illustrating one example of a gate driver included in a display device of FIG. 1. FIG. 3 is a diagram illustrating an example in which a gate driver of FIG. 2 is located in a display region. FIGS. 4 and 5 are circuit diagrams illustrating an example of stages included in a gate driver of FIG. 3.

Referring to FIGS. 2 through 5, each of stages 110-1 through 110-*n* in the gate driver 110A may be divided into a plurality of sub-blocks. At least one pixel circuit PX may be located between two adjacent sub-blocks. Therefore, split stages 110-1 through 110-*n* of the gate driver 110A may be inserted in a portion of the display region DR.

As shown in FIGS. 2 and 3, the gate driver 110A may include first through (n)th stages 110-1 through 110-*n*. The gate driver 110A may be located in the circuit region IRA included in the display region. For example, the first stage 110-1 may include first through fifth sub-blocks SB1-1 through SB1-5 sequentially arranged in a first direction D1. At least one pixel circuit PX may be located between the first sub-block SB1-1 and the second sub-block SB1-2, between the second sub-block SB1-2 and the third sub-block SB1-3, between the third sub-block SB1-3 and the fourth sub-block SB1-4, and between the fourth sub-block SB1-4 and the fifth sub-block SB1-5, respectively.

The sub-blocks may receive a clock signal from at least one vertical clock line extending in the second direction and may receive a gate voltage from at least one voltage line extending in the second direction.

In one example embodiment, each of the stages 110-1 through 110-*n* may receive a first gate clock signal GCK1 from a first vertical clock line CL1 and a third vertical clock line CL3 that extend in the second direction. The first gate clock signal GCK1 and a second gate clock signal GCK2 may have different timings. For example, the second gate clock signal GCK2 may be a signal inverted from the first gate clock signal GCK1. In adjacent stages, the first gate clock signal GCK1 and the second gate clock signal GCK2 may be applied in opposite sequences. For example, the odd-numbered stages (e.g., the first stage 110-1) may receive the first gate clock signal GCK1 as the first clock signal and may receive the second gate clock signal GCK2 as the second clock signal, while, the even-numbered stages (e.g., the second stage 110-2) may receive the second gate clock signal GCK2 as the first clock signal and may receive the first gate clock signal GCK1 as the second clock signal.

In one example embodiment, each of the stages 110-1 through 110-*n* may receive a first gate voltage VGL corresponding to a first logic level from a first voltage line VIA and a third voltage line VL3 that extend in the second direction. In addition, each of the stages 110-1 through 110-*n* may receive a second gate voltage VC H corresponding to a second logic level from a second voltage line VL2 and a fourth voltage line VIA that extend in the second direction. For example, the first gate voltage VGL may correspond to low-level voltage, and the second gate voltage VGH may correspond to a high-level voltage low-level voltage>high-level voltage).

The stages 110-1 through 110-*n* may receive a previous gate signal from one of previous stages or a vertical start signal STV as an input signal. For example, the first stage 110-1 may receive the vertical start signal STV, and each of the second through (n)th stages 110-2 through 110-*n* may receive a gate signal of a previous stage. The stages 110-1 through 110-*n* may respectively output the gate signal G1 through CM to the gate lines GL1 through GLn extending in the first direction D1.

As shown in FIGS. 4 and 5, each of the stages 110-1 through 110-*n* may be divided into a plurality of sub-blocks. Thus, the gate driver 110A is split and disposed between the pixel circuits PX. Accordingly, each sub-block may have a relatively small size. For example, each sub-block may include a number of transistors not exceeding 2 and a number of vertical lines (e.g., vertical voltage line, vertical clock line, etc) not exceeding 2.

In FIG. 4, odd-number stages may receive the first gate clock signal GCK1 as the first clock signal via the first and third clock lines CL1 and CL3 and may receive the second gate clock signal GCK2 as the second clock signal via the second and fourth clock lines CL2 and CL4. For example, the first stage 110-1 may include first through fifth sub-blocks SB1-1 through SB1-5 sequentially arranged in the first direction D1. Because structures of the odd-number stages may be substantially the same as each other, hereinafter, the structures of the odd-number stages will be described using the first stage 110-1 as an example.

The third sub-block SB1-3 may receive the vertical start signal STV as the input signal and may control a first node N1 and a second node N2 in response to a first clock signal (i.e., the first gate clock signal GCK1). In one example embodiment, the third sub-block SB1-3 may include a first input transistor TR1 and a second input transistor TR4. The first input transistor TR1 may include a gate electrode receiving the first clock signal, a first electrode receiving the input signal, and a second electrode connected to the first node N1. The second input transistor TR4 may include a gate electrode connected to the first node N1, a first electrode receiving the first clock signal, and a second electrode connected to the second node N2.

The fourth sub-block SB1-4 may be located between the first node N1 and a third node N3 and may decrease a voltage of the first node N1. In one example embodiment, the fourth sub-block SB1-4 may include a reducing transistor TR6 including a gate electrode receiving a first gate voltage VGL from a third voltage line VL3, a first electrode connected to the first node N1, and a second electrode connected to the third node N3.

The fifth sub-block SB1-5 may control the gate signal G1 as a first logic level or a second logic level in response to a voltage of the second node N2 and a voltage of the third node N3. In one example embodiment, the fifth sub-block SB1-5 may include a first output transistor TR8, a second capacitor C2, and a second output transistor TR7. The first output transistor TR8 may include a gate electrode connected to the third node N3, a first electrode receiving a second clock signal, and a second electrode connected to a first output terminal to which the gate signal G1 is outputted. The second capacitor C2 may include a first electrode connected to the third node N3 and a second electrode connected to the first output terminal. The second output transistor TR2 may include a gate electrode connected to the second node N2, a first electrode receiving a second gate voltage VGH from a fourth vertical voltage line VL4, and a second electrode connected to the first output terminal.

The first sub-block SB1-1 may maintain the voltage of the second node N2 as the first logic level in response to the first clock signal. In one example embodiment, the first sub-block SB1-1 may include a holding transistor TR5 and a first capacitor C1. The holding transistor TR5 may include a gate electrode receiving the first clock signal, a first electrode receiving a first gate voltage VGL from a first vertical voltage line VL1, and a second electrode connected to the second node N2. The first capacitor C1 may include a first electrode connected to the second node N2 and a second electrode receiving a second gate voltage VGH from a second vertical voltage line VL2.

The second sub-block SB1-2 may stabilize the gate signal G1 in response to the voltage of the second node N2 and a second clock signal. In one example embodiment, the second sub-block SB1-2 may include a first stabilizing transistor TR2 and a second stabilizing transistor TR3. The first stabilizing transistor TR2 may include a gate electrode connected to the second node N2, a first electrode receiving a second gate voltage VGH from a second vertical voltage line VL2, and a second electrode connected to a first electrode of the second stabilizing transistor TR3. The second stabilizing transistor TR3 may include a gate electrode receiving the second clock signal, a first electrode connected to the second electrode of the first stabilizing transistor TR2, and a second electrode connected to the first node N1.

In FIG. 5, even-number stages (e.g., the second stage 110-2) may receive the second gate clock signal GCK2 as the first clock signal via the second and fourth clock lines CL2 and CL4 and may receive the first gate dock signal GCK1 as the second clock signal via the first and third clock lines CL1 and CL3. Structures of the even-number stages, such as the second stage 110-2, are substantially the same as the structures of the odd-number stages, except that the first clock signal and the second clock signal are swapped or applied in reverse. Therefore, duplicate descriptions will be omitted.

In one example embodiment, at least one the voltage line may be connected to both of the gate driver 110A and the pixel circuit PX. Accordingly, for example, the high-level voltage (e.g., the second gate voltage VGH) applied to the gate driver 110A may be substantially the same as a voltage applied to the pixel circuit PX. In addition, voltage wirings may be arranged in a mesh form in the display region, thereby improving a uniformity of a voltage provided to the pixel circuits PX via the voltage lines.

Figure 6:
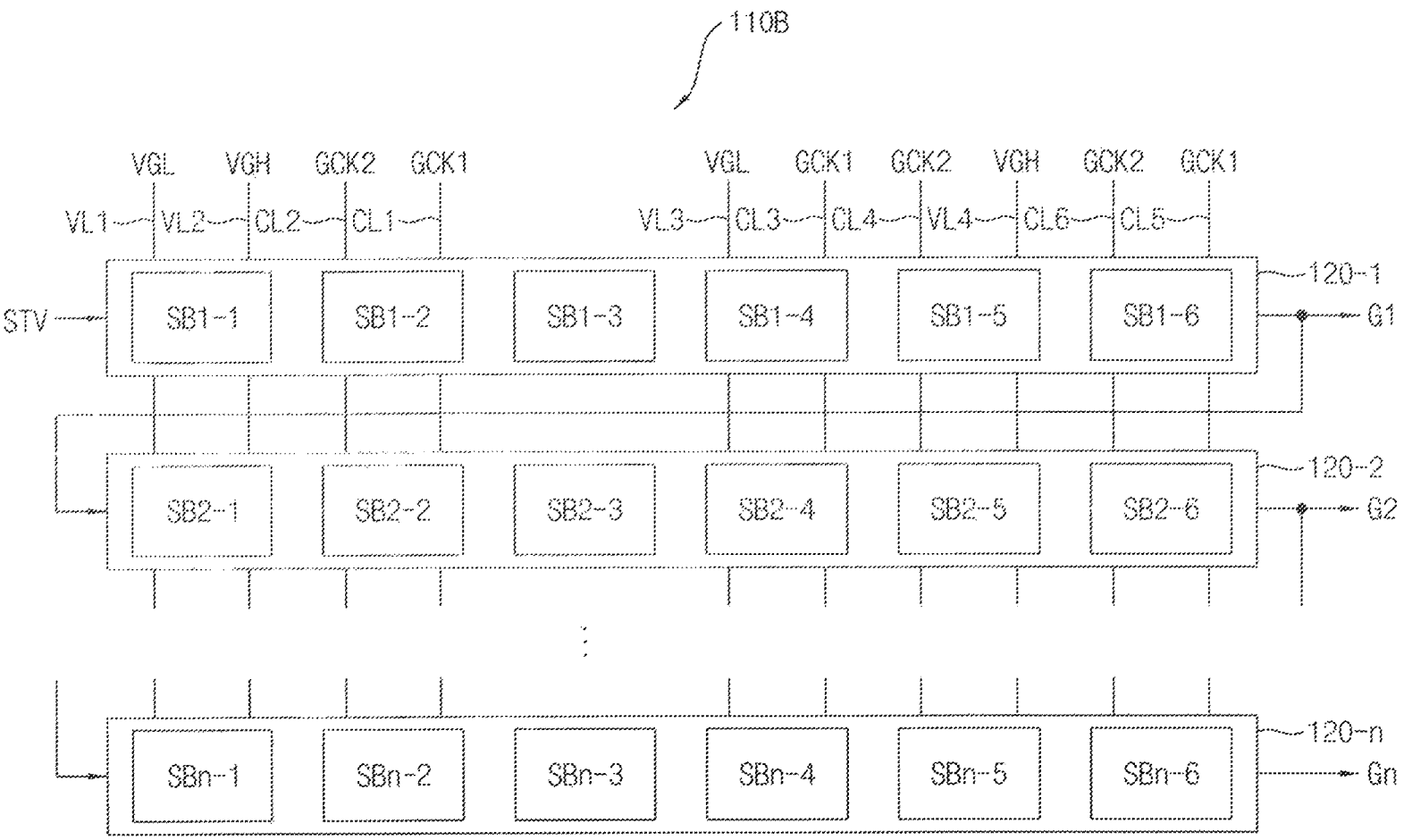
FIG. 6 is a block diagram illustrating another example of a gate driver included in a display device of FIG. 1.
Figure 7:
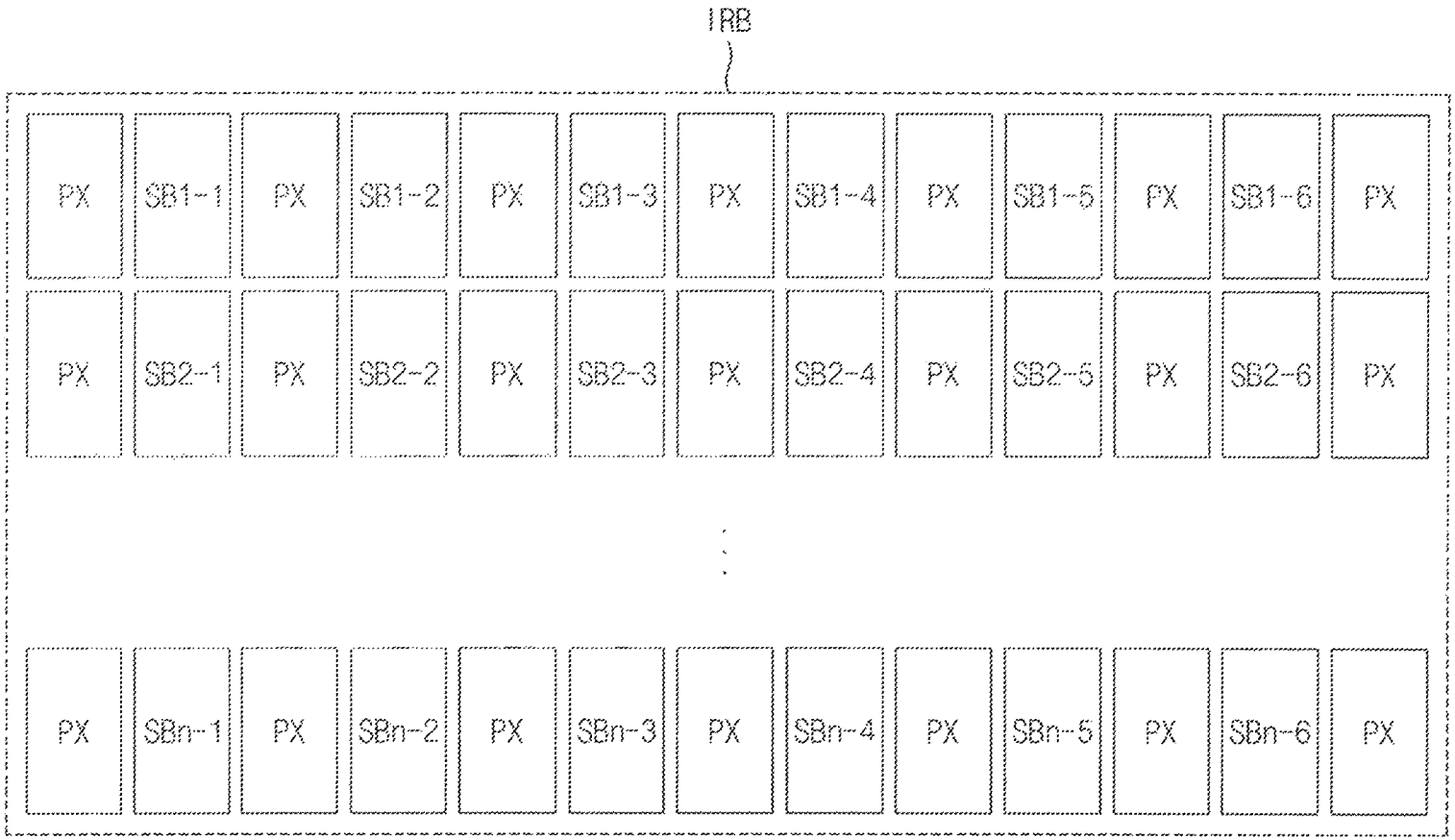
FIG. 7 is a diagram illustrating an example in which a gate driver of FIG. 6 is located in a display region.
Figure 8:
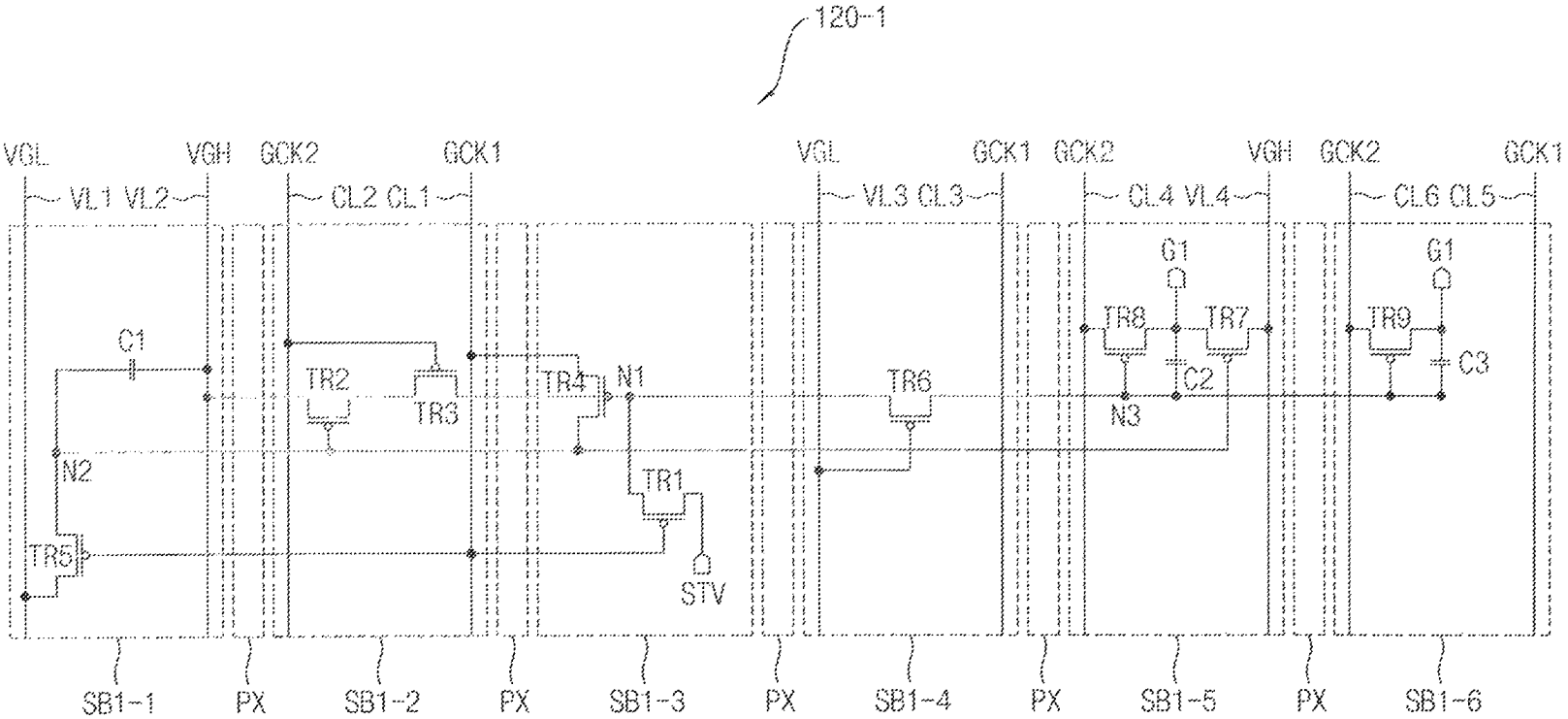
FIGS. 8 and 9 are circuit diagrams illustrating an example of stages included in a gate driver of FIG. 6.
Figure 9:
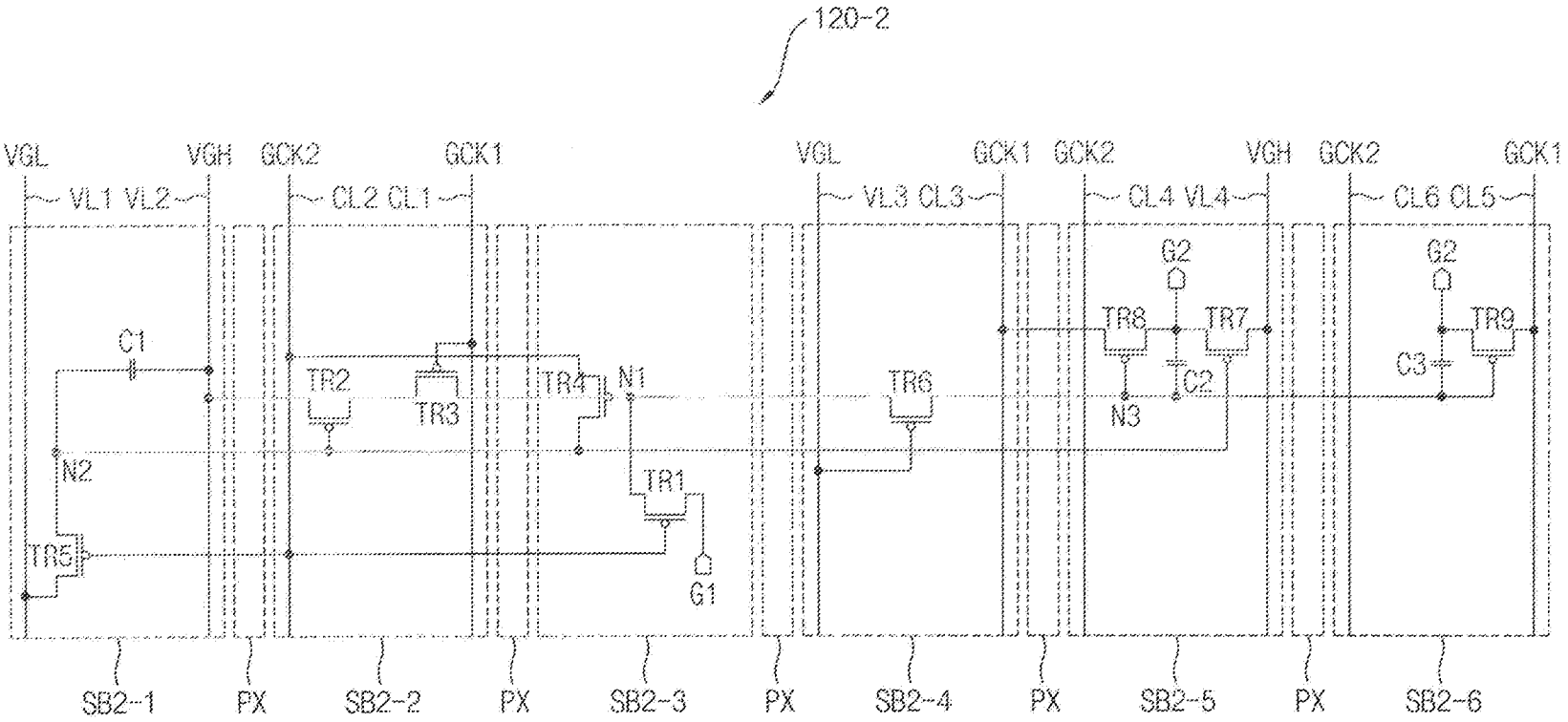

FIG. 6 is a block diagram illustrating another example of a gate driver included in a display device of FIG. 1. FIG. 7 is a diagram illustrating an example in which a gate driver of FIG. 6 is located in a display region. FIGS. 8 and 9 are circuit diagrams illustrating an example of stages included in a gate driver of FIG. 6.

Referring to FIGS. 6 through 9, each of the stages 120-1 through **120-*n* of the gate driver 110B may be divided into a plurality of sub-blocks. At least one pixel circuit PX may be located between two adjacent sub-blocks. The gate driver 110B according to the present exemplary embodiment is substantially the same as the gate driver of the exemplary embodiment described with respect to FIGS. 2 through 5, except that each of the stages 120-1 through 120-*n* of the gate driver 110B further includes a sixth sub-block SB1-6. Therefore, the same reference numerals will be used to refer to the same or like parts as those described in the previous exemplary embodiment of FIGS. 2 through 5**, and any repetitive explanation concerning the above elements will be omitted.

As shown in FIGS. 6 and 7, the gate driver 110B may include first through (n)th stages 120-1 through **120-*n* progressively outputting first through (n)th gate signals to the first through (n)th gate lines GL1 through GLn. The gate driver 110B may be located in the circuit region IRB included in the display region. For example, the first stage 120-1 may include first through sixth sub-blocks SB1-1 through SB1-6 sequentially arranged in the first direction D1**.

The sub-blocks may receive a clock signal from at least one vertical clock line extending in the second direction D2 and may receive a gate voltage from at least one voltage line extending in the second direction D2.

As shown in FIG. 8, odd-number stages may receive the first gate clock signal GCK1 as the first clock signal via the first, third, and fifth clock lines CL1, CL3, and CL5 and may receive the second gate clock signal GCK2 as the second clock signal via the second, fourth, and sixth clock lines CL2, CL4, and CL6. For example, the first stage 120-1 may include first through sixth sub-blocks SB1-1 through SB1-6 sequentially arranged in the first direction D1. Because structures of the odd-number stages may be substantially the same as each other, hereinafter, the structures of the odd-number stages will be described using the first stage 120-1 as an example.

The third sub-block SB1-3 may receive the vertical start signal STV as the input signal and may control a first node N1 and a second node N2 in response to a first clock signal (i.e., the first gate clock signal GCK1).

The fourth sub-block SB1-4 may be located between the first node N1 and a third node N3 and may decrease a voltage of the first node N1.

The fifth sub-block SB1-5 may control the gate signal G1 as a first logic level or a second logic level in response to a voltage of the second node N2 and a voltage of the third node N3. In one example embodiment, the fifth sub-block SB1-5 may include a first output transistor TR8, a second capacitor C2, and a second output transistor TR7. The first output transistor TR8 may include a gate electrode connected to the third node N3, a first electrode receiving a second clock signal, and a second electrode connected to a first output terminal to which the gate signal G1 is outputted. The second capacitor C2 may include a first electrode connected to the third node N3 and a second electrode connected to the first output terminal. The second output transistor TR7 may include a gate electrode connected to the second node N2, a first electrode receiving a second gate voltage VGH from a fourth vertical voltage line VL4 and a second electrode connected to the first output terminal.

The sixth sub-block SB1-6 may control the gate signal G1 as the first logic level in response to the voltage of the third node N3. According to an example embodiment, a size of the first output transistor TR8 is greater than a size of the second output transistor TR7 to prevent an unstable output of the gate signal owing to the leakage current. At the same time, a size of the sub-block may be limited to interpose the sub-block between two adjacent pixel circuits. Therefore, each stage may further include a sixth sub-block SB1-6 performing a role as an output buffer. In one example embodiment, the sixth sub-block SB1-6 may include a third output transistor TR9 and a third capacitor C3. The third output transistor TR9 may include a gate electrode connected to the third node N3, a first electrode receiving the second clock signal, and a second electrode connected to a second output terminal to which the gate signal G1 is outputted. The third capacitor C3 may include a first electrode connected to the third node N3 and a second electrode connected to the second output terminal. In one example embodiment, both of the first output terminal and the second output terminal may be connected to the same gate line. In another example embodiment, one output terminal may be connected to the gate line, and the other output terminal may be connected to the next stage to provide the gate signal as the input signal to the next stage.

The first sub-block SB1-1 may maintain the voltage of the second node N2 as the first logic level in response to the first clock signal.

The second sub-block SB1-2 may stabilize the gate signal in response to the voltage of the second node N2 and a second clock signal.

In FIG. 9, even-number stages (e.g., the second stage 120-2) may receive the second gate clock signal GCK2 as the first clock signal via the second, fourth, and sixth clock lines CL2, CL4, and CL6 and may receive the first gate clock signal GCK1 as the second clock signal via the first, third, and fifth clock lines CL1, CL3, and CL5. Structures of the even-number stages, such as the second stage 120-2, are substantially the same as the structures of the odd-number stages, except that the first clock signal and the second clock signal are swapped or applied in reverse. Therefore, duplicate descriptions will be omitted.

Figure 10:
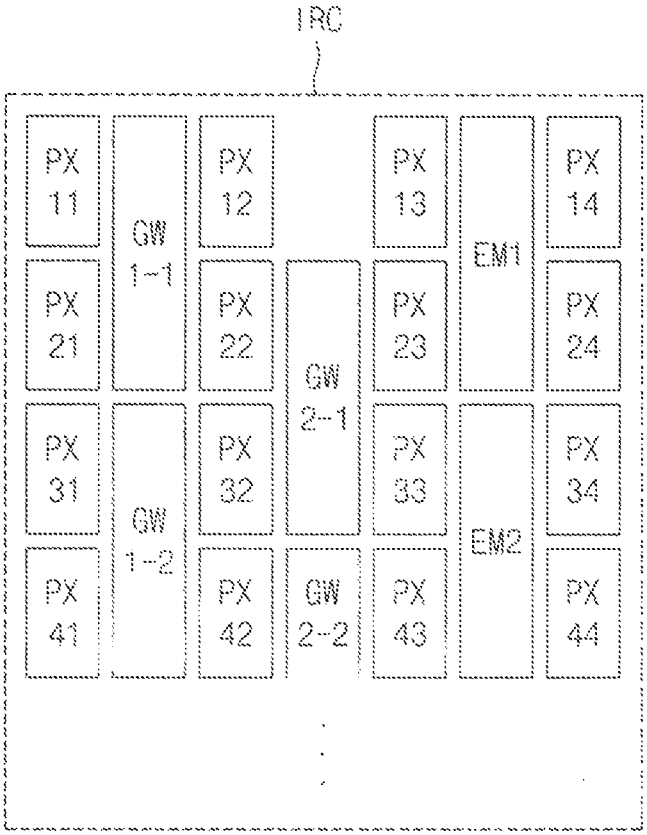
FIGS. 10 and 11 are diagrams illustrating other examples in which a gate driver included in a display device of FIG. 1 is located in a display region.
Figure 11:
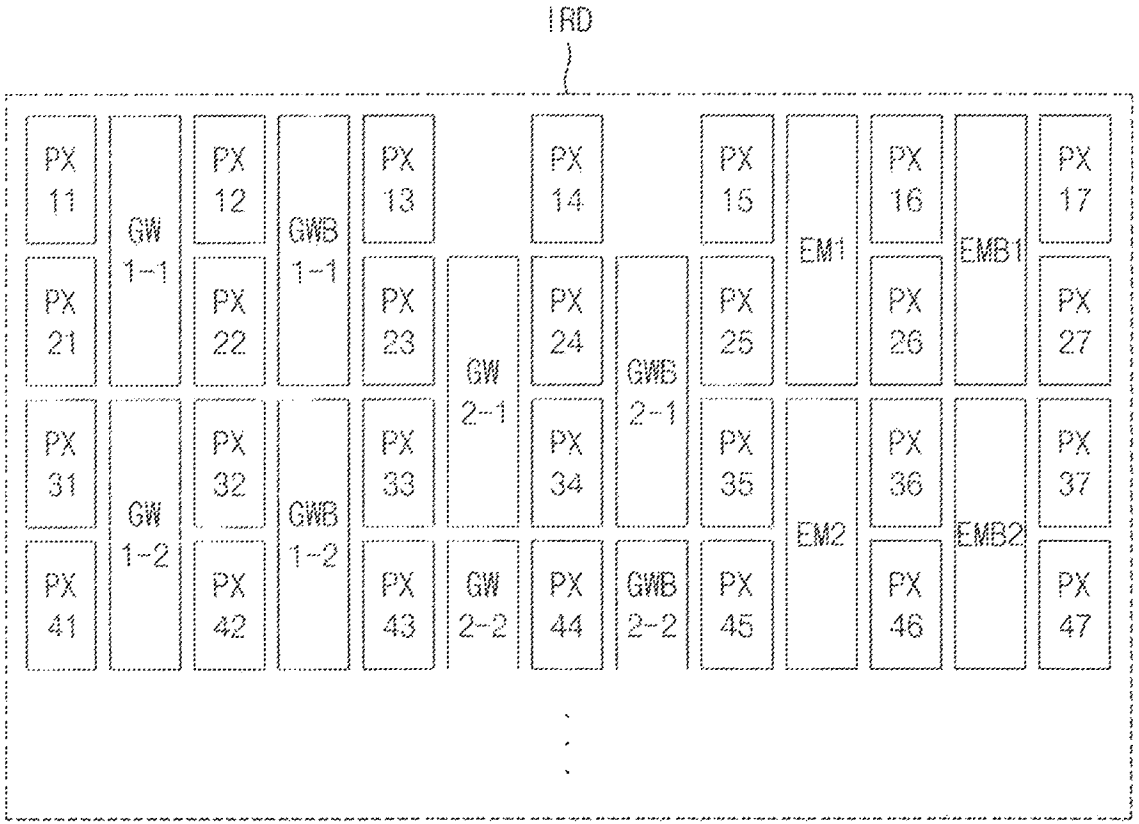

FIGS. 10 and 11 are diagrams illustrating other examples in which a gate driver included in a display device of FIG. 1 is located in a display region.

Referring to FIGS. 10 and 11, stages of the gate driver may be located between two adjacent pixel columns, which corresponding to at least two pixel rows, to secure a space in which the gate driver is interposed in the display region.

As shown in FIG. 10, the display device may include gate drivers (i.e., a first gate driver, a second gate driver) and an emission control driver in the circuit region IRC of the display region. At least one pixel column may be located between the first gate driver and the second gate driver. In addition, at least one pixel column may be located between the second gate driver and the emission control driver.

The first gate driver may include stages GW1-1, GW1-2, etc., that provide the gate signal to odd-number pixel rows. The stages GW1-1, GW1-2, etc., in the first gate driver may be located between the first pixel column and the second pixel column. In addition, each of the stages GW1-1, GW1-2, etc., in the first gate driver may be disposed corresponding to two pixel rows. For example, a first stage GW1-1 in the first gate driver may correspond to a first pixel row including pixel circuits PX11 and PX12 and a second pixel row including pixel circuits PX21 and PX22. Also, a second stage GW1-2 in the first gate driver may correspond to a third pixel row including pixel circuits PX31 and PX32 and a fourth pixel row including pixel circuits PX41 and PX42.

The second gate driver may include stages GW2-1, GW2-2, etc., that provide the gate signal to even-number pixel rows. The stages GW2-1, GW2-2, etc., in the second gate driver may be located between the second pixel column and the third pixel column. In addition, each of the stages GW2-1, GW2-2, etc., in the second gate driver may be disposed corresponding to two pixel rows. For example, a first stage GW2-1 in the second gate driver may correspond to a second pixel row including pixel circuits PX22 and PX23 and a third pixel row including pixel circuits PX32 and PX33. Also, a second stage GW2-2 in the second gate driver may correspond to a fourth pixel row including pixel circuits PX41 and PX42 and a fifth pixel row.

The emission control driver may include stages EM1, EM2, etc., each providing the emission control signal to two adjacent pixel rows. The emission control driver may be located between a third pixel column and a fourth pixel column. In addition, each of the stages EM1, EM2, etc., in the emission control driver may be disposed corresponding to two pixel rows. For example, a first stage EM1 in the emission control driver may correspond to a first pixel row including pixel circuits PX13 and PX14 and a second pixel row including pixel circuits PX23 and PX24. Also, a second stage EM2 in the emission control driver may correspond to a third pixel row including pixel circuits PX33 and PX34 and a fourth pixel row including pixel circuits PX43 and PX44.

As shown in FIG. 11, the display device may include gate drivers (i.e., a first gate driver, a second gate driver) and an emission control driver in the circuit region IRD of the display region. Each stage in the gate drivers or the emission control driver may be divided into a plurality of sub-blocks, and each sub-block may be interposed between adjacent pixel circuits.

The first gate driver may include stages that provide the gate signal to odd-number pixel rows. Each stage in the first gate driver may be divided into a plurality of sub-blocks, and at least one pixel circuit may be located between two adjacent sub-blocks. For example, the first stage of the first gate driver may include a first sub-block GW1-1 and a second sub-block GWB1-1. Here, the second sub-block GWB1-1 may function as an output buffer to stably output the gate signal. The first sub-blocks GW1-1, GW1-2, etc., in the first gate driver may be located between the first pixel column and the second pixel column. In addition, the first sub-blocks GW1-1, GW1-2, etc., in the first gate driver may be disposed corresponding to two pixel rows. For example, a first stage GW1-1, GWB1-1 in the first gate driver may correspond to a first pixel row including pixel circuits PX11, PX12, and PX13 and a second pixel row including pixel circuits PX21, PX22, and PX23. Also, a second stage GW1-2 GWB1-2 in the first gate driver may correspond to a third pixel row including pixel circuits PX31, PX32, and PX33 and a fourth pixel row including pixel circuits PX41, PX42, and PX43.

The second gate driver may include stages that provide the gate signal to even-number pixel rows. Each stage in the second gate driver may be divided into a plurality of sub-blocks, and at least one pixel circuit may be located between two adjacent sub-blocks. For example, the first stage of the second gate driver may include a first sub-block GW2-1 and a second sub-block GWB2-1. Here, the second sub-block GWB2-1 may function as an output buffer to stably output the gate signal. The first sub-blocks GW2-1, GW2-2, etc., in the second gate driver may be located between the third pixel column and the fourth pixel column. In addition, the first sub-blocks GW2-1, GW2-2, etc in the second gate driver may be disposed corresponding to two pixel rows. For example, a first stage GW2-1, GWB2-1 in the second gate driver may correspond to a second pixel row including pixel circuits PX23, PX24, and PX25 and a third pixel row including pixel circuits PX33, PX34, and PX35.

Also, a second stage GW2-2, GWB2-2 in the second gate driver may correspond to a fourth pixel row including pixel circuits PX43, PX44, and PX45 and a fifth pixel row.

The emission control driver may include stages each providing the emission control signal to two adjacent pixel rows. Each stage in the emission control driver may be divided into a plurality of sub-blocks, and at least one pixel circuit may be located between two adjacent sub-blocks. For example, the first stage of the emission control driver may include a first sub-block EM1 and a second sub-block EMB1. Here, the second sub-block EMB1 may function as an output buffer to stably output the emission control signal. The first sub-blocks EM1, EM2, etc., in the emission control driver may be located between the fifth pixel column and the sixth pixel column. In addition, the first sub-blocks EM1, EM2, etc., in the emission control driver may be disposed corresponding to two pixel rows. For example, a first stage EM1, EMB1 in the emission control driver may correspond to a first pixel row including pixel circuits PX15, PX16, and PX17 and a second pixel row including pixel circuits PX25, PX26, and PX27. Also, a second stage EM2, EMB2 in the emission control driver may correspond to a third pixel row including pixel circuits PX35, PX36, and PX37 and a fourth pixel row including pixel circuits PX45, PX46, and PX47.

Although the example embodiments of FIGS. 10 and 11 show that the display device includes the gate drivers such as the first gate driver and the second gate driver, and the emission control driver, it is not limited thereto. In one example, the gate driver may further include a third gate driver providing an initialization control signal as a gate signal to the pixel circuits. In another example, the first gate driver and/or the second gate driver provide the initialization control signal to the pixel circuits.

Figure 12:
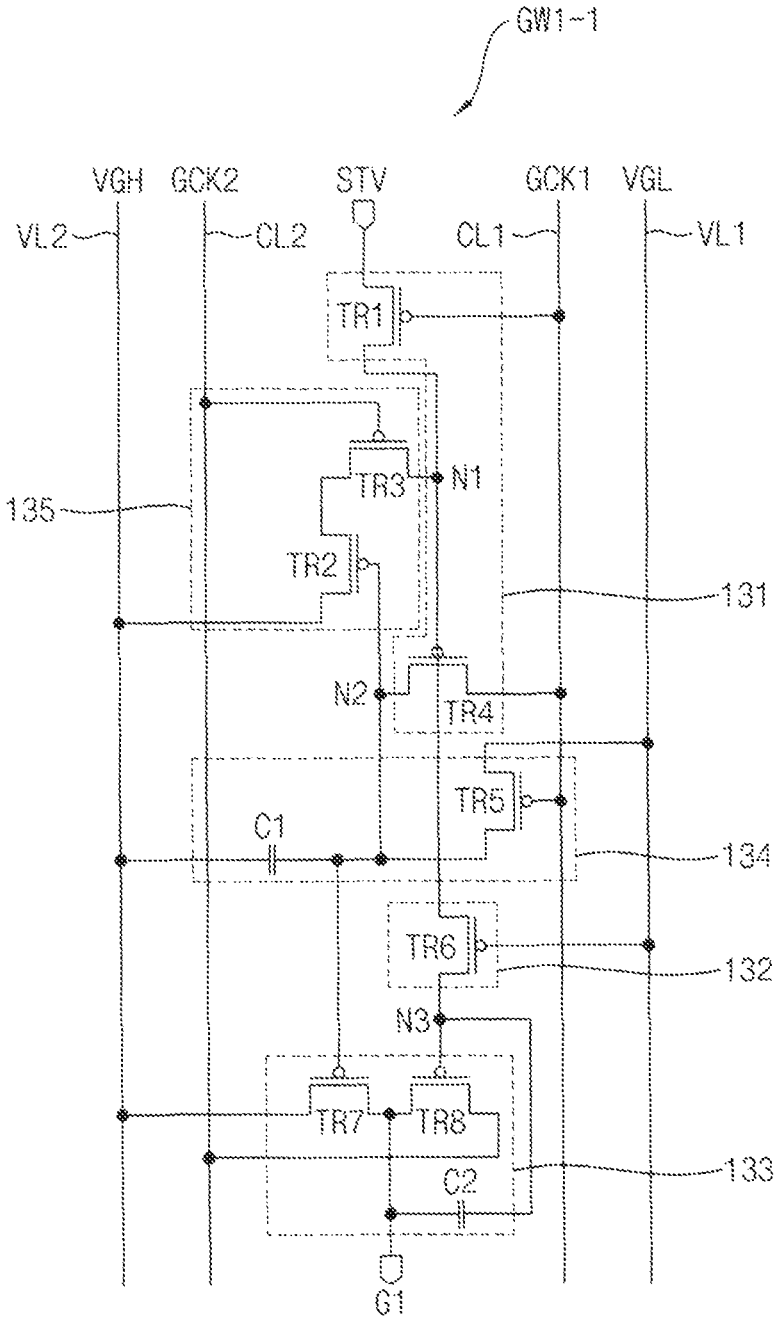
FIG. 12 is circuit diagram illustrating an example of a stage included in a first gate driver of FIG. 10.

FIG. 12 is circuit diagram illustrating an example of a stage included in a first gate driver of FIG. 10.

Referring to FIG. 12, stages in the first gate driver may receive a clock signal from at least one vertical clock line extending in the second direction D2 and receive a gate voltage from at least one voltage line extending in the second direction D2.

The odd-numbered stages in the first gate driver may receive a first gate clock signal GCK1 as a first clock signal via a first clock line CL1 and may receive a second gate clock signal GCK2 as a second clock signal via a second clock line CL2.

The first stage GW1-1 in the first gate driver may include an input circuit 131, a load reducing circuit 132, an output circuit 133, a holding circuit 134, and a stabilizing circuit 135. Because the structures of the odd-number stages may be substantially the same as each other, hereinafter, the structures of the odd-number stages will be described using the first stage GW1-1 as an example.

The input circuit 131 may receive a vertical start signal STV as the input signal and may control a first node N1 and a second node N2 in response to a first clock signal (i.e., the first gate clock signal GCK1). In one example embodiment, the input circuit 131 may include a first input transistor TR1 and a second input transistor TR4. The first input transistor TR1 ray include a gate electrode receiving the first clock signal, a first electrode receiving the input signal, and a second electrode connected to the first node N1. The second input transistor TR4 may include a gate electrode connected to the first node N1, a first electrode receiving the first clock signal, and a second electrode connected to the second node N2.

The load reducing circuit 132 may be located between the first node N1 and a third node N3 and may decrease a voltage of the first node N1. In one example embodiment, the load reducing circuit 132 may include a reducing transistor TR6 including a gate electrode receiving a first gate voltage VGL from a first voltage line VL1, a first electrode connected to the first node N1, and a second electrode connected to the third node N3.

The output circuit 133 may control the gate signal G1 as a first logic level or a second logic level in response to a voltage of the second node N2 and a voltage of the third node N3. In one example embodiment, the output circuit 133 may include a first output transistor TR8, a second capacitor C2, and a second output transistor TR7. The first output transistor TR8 may include a gate electrode connected to the third node N3, a first electrode receiving a second clock signal, and a second electrode connected to an output terminal to which the gate signal G1 is outputted. The second capacitor C2 may include a first electrode connected to the third node N3 and a second electrode connected to the output terminal. The second output transistor TR7 may include a gate electrode connected to the second node N2, a first electrode receiving a second gate voltage VGH from a second vertical voltage line VL2, and a second electrode connected to the output terminal.

The holding circuit 134 may maintain the voltage of the second node N2 as the first logic level in response to the first clock signal. In one example embodiment, the holding circuit 134 may include a holding transistor TR5 and a first capacitor C1. The holding transistor TR5 may include a gate electrode receiving the first clock signal, a first electrode receiving a first gate voltage VGL from a first vertical voltage line VL1, and a second electrode connected to the second node N2. The first capacitor C1 may include a first electrode connected to the second node N2 and a second electrode receiving a second gate voltage VGH from a second vertical voltage line VL2.

The stabilizing circuit 135 may stabilize the gate signal in response to the voltage of the second node N2 and a second clock signal. In one example embodiment, the stabilizing circuit 135 may include a first stabilizing transistor TR2 and a second stabilizing transistor TR3. The first stabilizing transistor TR2 may include a gate electrode connected to the second node N2, a first electrode receiving a second gate voltage VGH from a second vertical voltage line VL2, and a second electrode connected to a first electrode of the second stabilizing transistor TR3. The second stabilizing transistor TR3 may include a gate electrode receiving the second clock signal, a first electrode connected to the second electrode of the first stabilizing transistor TR2, and a second electrode connected to the first node N1.

The even-numbered stages in the first gate driver may receive a second gate clock signal GCK2 as a first clock signal via a second clock line CL2 and may receive a first gate clock signal GCK1 as a second clock signal via a first clock line CL1.

The second stage GW1-2 in the first gate driver may include an input circuit 131, a load reducing circuit 132, an output circuit 133, a holding circuit 134, and a stabilizing circuit 135. Structures of the even-number stages in the first gate driver are substantially the same as the structures of the first stage GW1-1 of the first gate driver, except that the first clock signal and the second clock signal are swapped or applied in reverse (e.g., GCK2 as the first clock signal and GCK1 as the second clock signal). Therefore, duplicate descriptions will be omitted.

FIGS. 13 through 16 are circuit diagrams illustrating examples of a pixel circuit included in a display device of FIG. 1.

Referring to FIGS. 13 through 16, at least one of the gate lines may be connected to a first pixel row and a second pixel row adjacent to the first pixel row. In one example embodiment, a structure of a first pixel circuit included in the first pixel row may be different from a structure of a second pixel circuit included in the second pixel row. Thus, pixel circuits adjacent to each other in the second direction D2 may share some of the gate lines and transistors to secure a space in which the gate driver is located within the circuit region of the display region.

Figure 13:
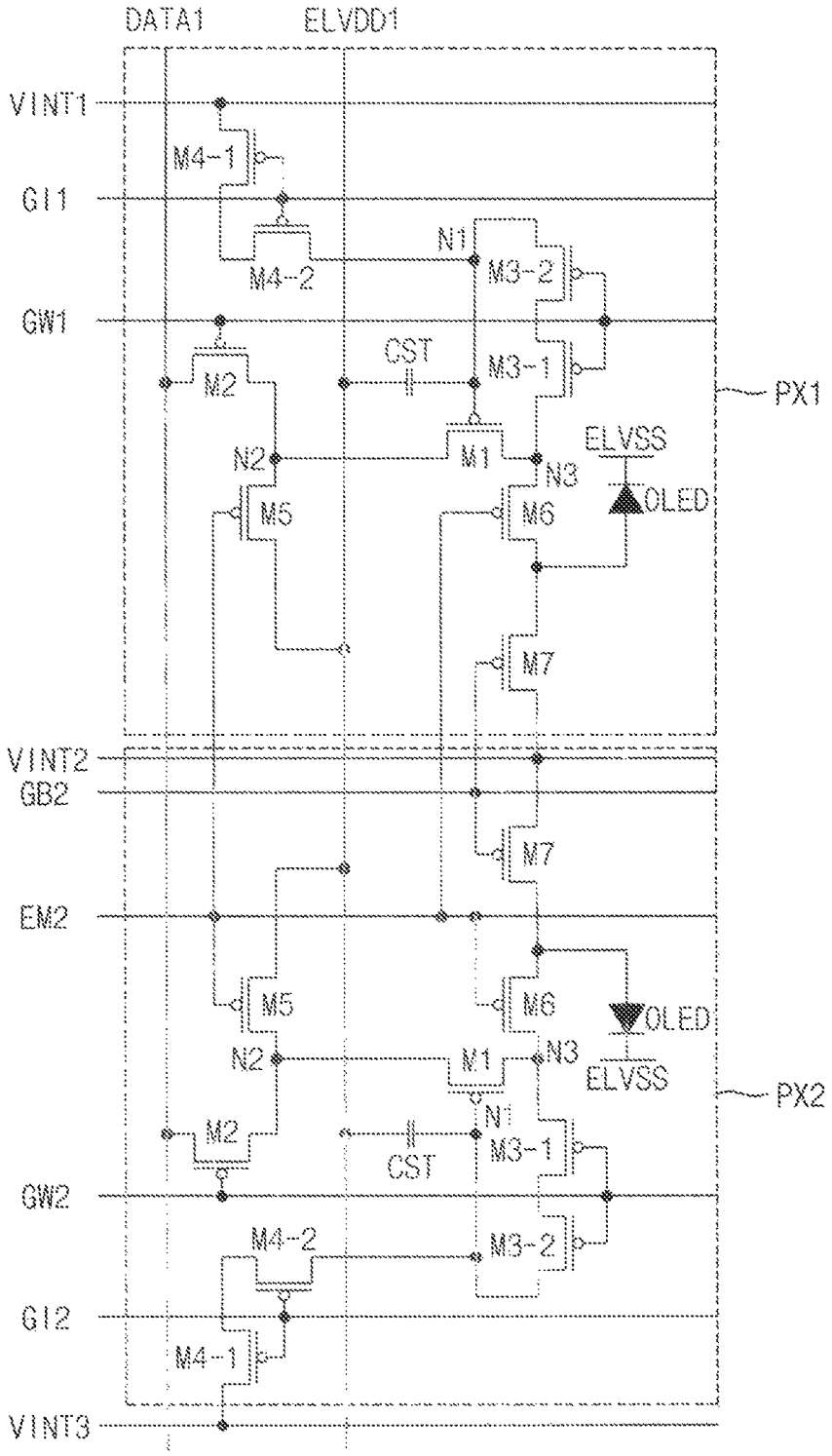
FIGS. 13, 14, 15 and 16 are circuit diagrams illustrating examples of a pixel circuit included in a display device of FIG. 1.

As shown in FIG. 13, the first pixel circuit PX1 in the first pixel row and the second pixel circuit PX2 in the second pixel row may share an emission control line and a second initialization control line as the gate line, wherein the second pixel circuit PX2 is adjacent to the first pixel circuit PX1 in the second direction.

Specifically, the first pixel circuit PX1 may include an organic light emitting diode (OLED), a plurality of transistors, and a capacitor CST.

The first transistor M1 in the first pixel circuit PX1 may include a gate electrode connected to the first node N1, a first electrode connected to the second node N2, and a second electrode connected to the third node N3.

The second transistor M2 in the first pixel circuit PX1 may include a gate electrode connected to the gate line GW1 corresponding to the first pixel row, a first electrode connected to the data line DATA1 corresponding to the first pixel column, and a second electrode connected to the second node N2.

The (3-1)th transistor M3-1 in the first pixel circuit PX1 may include a gate electrode connected to the gate line GW1 corresponding to the first pixel row, a first electrode connected to the third node N3, and a second electrode.

The (3-2)th transistor M3-2 in the first pixel circuit PX1 may include a gate electrode connected to the gate line GW1 corresponding to the first pixel row, a first electrode connected to the second electrode of the (3-1)th transistor M3-1, and a second electrode connected to the first node N1.

The (4-1)th transistor M4-1 in the first pixel circuit PX1 may include a gate electrode connected to the first initialization control line GI1 corresponding to the first pixel row, a first electrode connected to the initialization voltage line VINT1 corresponding to the first pixel row, and a second electrode.

The (4-2)th transistor M4-2 in the first pixel circuit PX1 may include a gate electrode connected to the first initialization control line GI1 corresponding to the first pixel row, a first electrode connected to the second electrode of the (4-1)th transistor M4-1, and a second electrode connected to the first node N1.

The fifth transistor M5 in the first pixel circuit PX1 may include a gate electrode connected to the emission control line EM2 corresponding to the second pixel row, a first electrode connected to the first pixel voltage line ELVDD1 corresponding to the first pixel column, and a second electrode connected to the second node N2.

The sixth transistor M6 in the first pixel circuit PX1 may include a gate electrode connected to the emission control line EM2 corresponding to the second pixel row, a first electrode connected to the third node N3, and a second electrode connected to the first electrode of OLED.

The seventh transistor M7 in the first pixel circuit PX1 may include a gate electrode connected to the second initialization control line GB2 corresponding to the second pixel row, a first electrode connected to the initialization voltage line VINT2 corresponding to the second pixel row, and a second electrode connected to the first electrode of OLED The capacitor CST in the first pixel circuit PX1 may include a first electrode connected to the first node N1 and a second electrode connected to the first pixel voltage line ELVDD1 corresponding to the first pixel column.

The second pixel circuit PX2 may include an OLED, a plurality of transistors, and a capacitor CST. A structure of the second pixel circuit PX2 may be substantially symmetrical with the first pixel circuit PX1.

The first transistor M1 in the second pixel circuit PX2 may include a gate electrode connected to the first node N1, a first electrode connected to the second node N2, and a second electrode connected to the third node N3.

The second transistor M2 in second pixel circuit PX2 may include a gate electrode connected to the gate line GW2 corresponding to the second pixel row, a first electrode connected to the data line DATA1 corresponding to the first pixel column, and a second electrode connected to the second node N2.

The (3-1)th transistor M3-1 in second pixel circuit PX2 may include a gate electrode connected to the gate line GW2 corresponding to the second pixel row, a first electrode connected to the third node N3, and a second electrode.

The (3-2)th transistor M3-2 in second pixel circuit PX2 may include a gate electrode connected to the gate line GW2 corresponding to the second pixel row, a first electrode connected to the second electrode of the (3-1)th transistor M3-1, and a second electrode connected to the first node N1.

The (4-1)th transistor M4-1 in second pixel circuit PX2 may include a gate electrode connected to the first initialization control line GI2 corresponding to the second pixel row, a first electrode connected to the initialization voltage line VINT3 corresponding to the third pixel row, and a second electrode.

The (4-2)th transistor M4-2 in second pixel circuit PX2 may include a gate electrode connected to the first initialization control line GI2 corresponding to the second pixel row, a first electrode connected to the second electrode of the (4-1)th transistor M4-1, and a second electrode connected to the first node N1.

The fifth transistor M5 in second pixel circuit PX2 may include a gate electrode connected to the emission control line EM2 corresponding to the second pixel row, a first electrode connected to the first pixel voltage line ELVDD1 corresponding to the first pixel column, and a second electrode connected to the second node N2.

The sixth transistor M6 in second pixel circuit PX2 may include a gate electrode connected to the emission control line EM2 corresponding to the second pixel row, a first electrode connected to the third node N3, and a second electrode connected to the first electrode of OLED.

The seventh transistor M7 in second pixel circuit PX2 may include a gate electrode connected to the second initialization control line GB2 corresponding to the second pixel row, a first electrode connected to the initialization voltage line VINT2 corresponding to the second pixel row, and a second electrode connected to the first electrode of OLED.

The capacitor CST in second pixel circuit PX2 may include a first electrode connected to the first node N1 and a second electrode connected to the first pixel voltage line ELVDD1 corresponding to the first pixel column.

Figure 14:
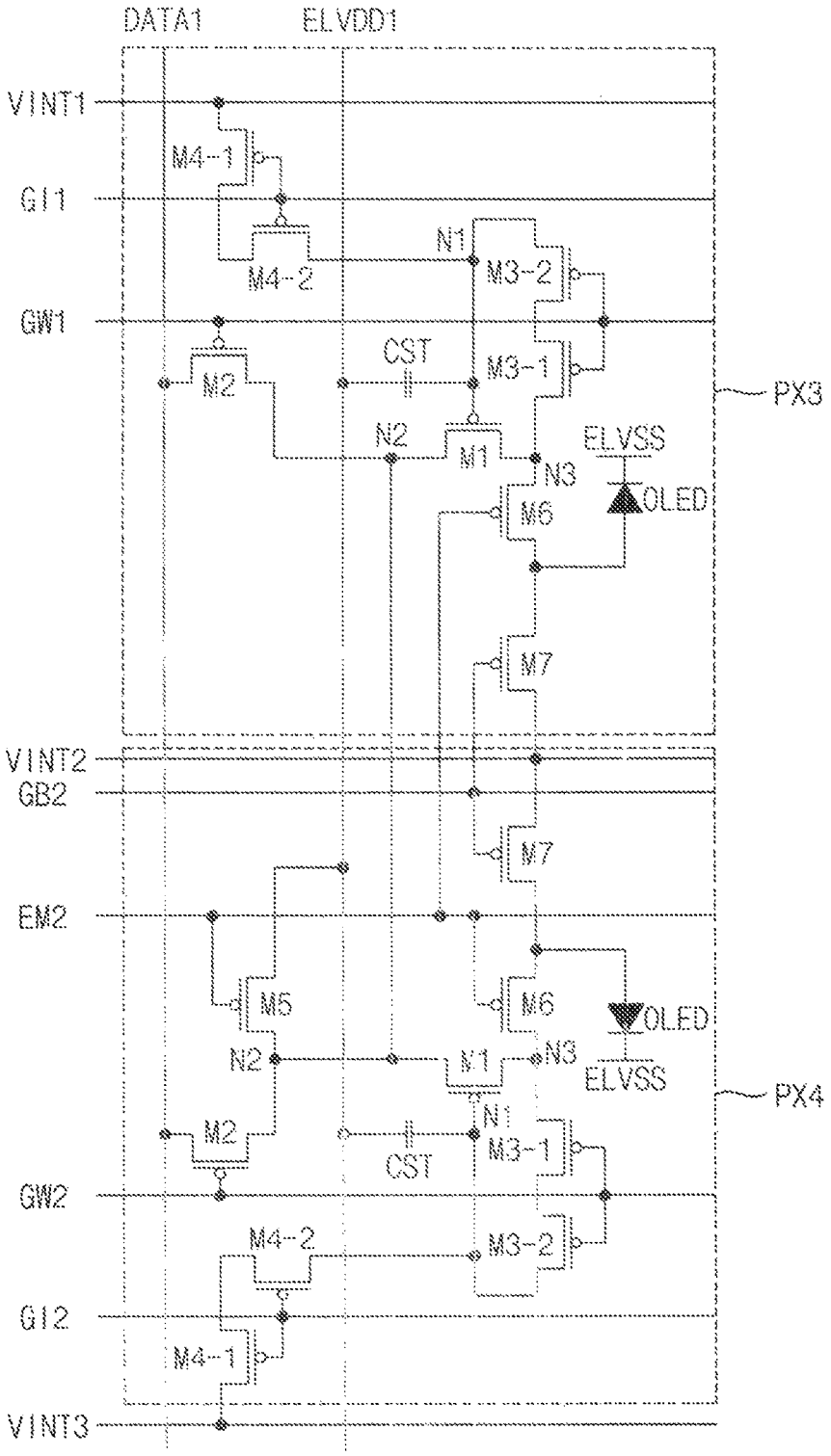

As shown in FIG. 14, the third pixel circuit PX3 in the first pixel row and the fourth pixel circuit PX4 in the second pixel row may share an emission control line and a second initialization control line as the gate line, wherein the fourth pixel circuit PX4 is adjacent to the third pixel circuit PX3 in the second direction. The third pixel circuit PX3 and the fourth pixel circuit PX4 according to the present exemplary embodiment are substantially the same as the first pixel circuit PX1 and the second pixel circuit PX2 of FIG. 13, respectively, except that the third pixel circuit PX3 does not include the fifth transistor M5 and the second node N2 of the third pixel circuit PX3 is connected to the second node N2 of fourth pixel circuit PX4. Therefore, duplicate descriptions will be omitted.

Figure 15:
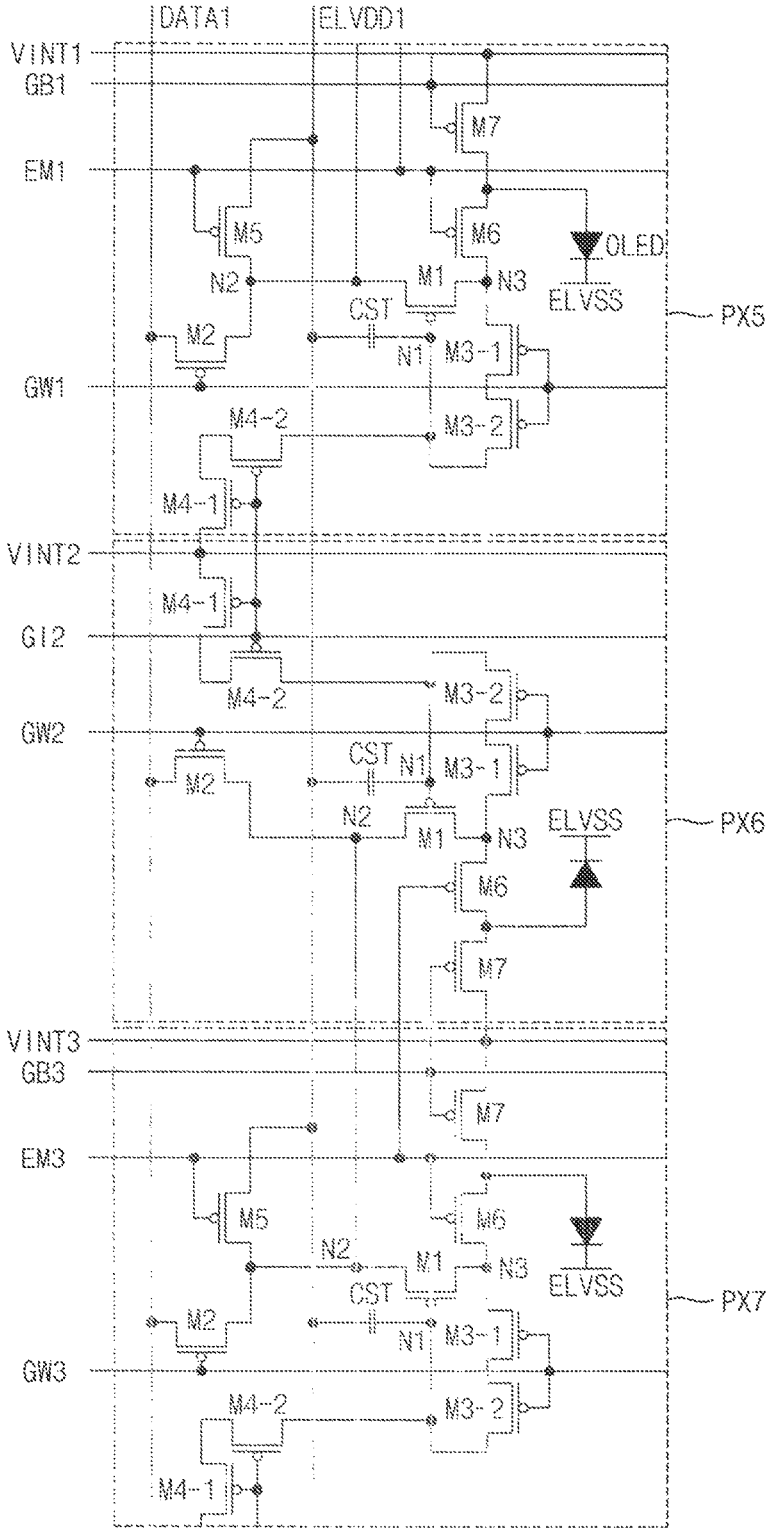

As shown in FIG. 15 the fifth pixel circuit PX5 in the first pixel row and the sixth pixel circuit PX6 in the second pixel row may share a first initialization control line as the gate line, wherein the sixth pixel circuit PX6 is adjacent to the fifth pixel circuit PX5 in the second direction. In addition, the sixth pixel circuit PX6 and the seventh pixel circuit PX7 in the third pixel row may share an emission control line and a second initialization control line as the gate line, wherein the seventh pixel circuit PX7 is adjacent to the sixth pixel circuit PX6 in the second direction.

The fifth pixel circuit PX5 and the seventh pixel circuit PX7 according to the present exemplary embodiment are substantially the same as the second pixel circuit PX2 of FIG. 13, except that the (4-1)th and (4-2)th transistors are connected to the first initialization control line corresponding to the adjacent pixel row. In addition, the sixth pixel circuit PX6 according to the present exemplary embodiment is substantially the same as the third pixel circuit PX3 of FIG. 14. Therefore, duplicate descriptions will be omitted.

Figure 16:
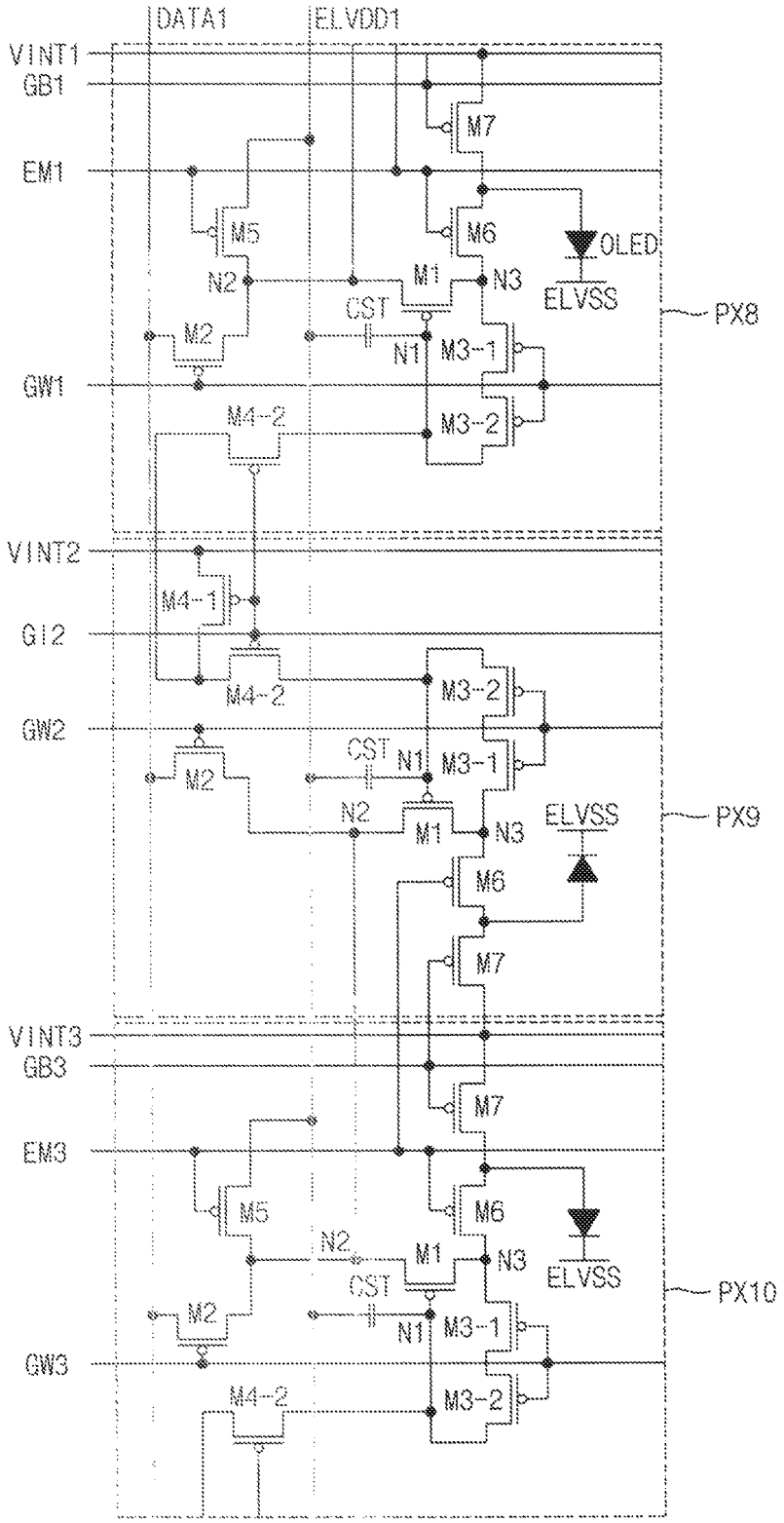

As shown in FIG. 16, the eighth pixel circuit PX8 in the first pixel row and the ninth pixel circuit PX9 in the second pixel row may share a first initialization control line as the gate line, wherein the ninth pixel circuit PX9 is adjacent to the eighth pixel circuit PX8 in the second direction. In addition, the ninth pixel circuit PX9 and the tenth pixel circuit PX10 in the third pixel row may share an emission control line and a second initialization control line as the gate line, wherein the tenth pixel circuit PX10 is adjacent to the ninth pixel circuit PX9 in the second direction.

The eighth pixel circuit PX8 and the tenth pixel circuit PX10 according to the present exemplary embodiment are substantially the same as the fifth pixel circuit PX5 and the seventh pixel circuit PX7 of FIG. 15, respectively, except that the (4-1)th transistor is shared with the adjacent pixel circuit. In addition, the ninth pixel circuit PX9 according to the present exemplary embodiment is substantially the same as the sixth pixel circuit PX6 of FIG. 15. Therefore, duplicate descriptions will be omitted.

Although a display device according to example embodiments have been described with reference to figures, those skilled in the art will readily appreciate that many modifications are possible in the example embodiments without materially departing from the novel teachings and advantages of the present inventive concept. For example, although the example embodiments describe that the pixel circuit and the gate driver include p-channel metal oxide semiconductor (PMOS)-type transistors, the type of transistor is not limited thereto.

The present inventive concept may be applied to an electronic device having the display device. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included to within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a plurality of pixel circuits arranged in a plurality of pixel rows extending in a first direction and a plurality of pixel columns extending in a second direction crossing the first direction; and a gate driver including a plurality of stages, each of the plurality of stages configured to output a gate signal to each of a plurality of gate lines extending in the first direction, respectively, to provide the gate signal to a corresponding pixel circuit of the plurality of pixel circuits, wherein each of the plurality of stages is divided into a plurality of sub-blocks each of which includes at least one switch, wherein each of the plurality of sub-blocks of each of the plurality of stages is disposed between adjacent two pixel columns, respectively, wherein at least one of the plurality of sub-blocks is configured to receive a clock signal from at least one vertical clock line extending in the second direction, wherein at least one of the plurality of sub-blocks is configured to receive a gate voltage from at least one voltage line extending in the second direction, wherein each of the plurality of stages includes first, second, third, fourth and fifth sub-blocks sequentially arranged in a first direction, wherein each of the plurality of stages includes first, second, third, fourth and fifth sub-blocks sequentially arranged in a first direction, wherein the third sub-block is configured to receive a previous gate signal from one of previous stages or a vertical start signal as an input signal and control a first node and a second node in response to a first clock signal, wherein the fourth sub-block is located between the first node and a third node and configured to decrease a voltage of the first node, wherein the fifth sub-block is configured to control the gate signal as a first logic level or a second logic level in response to a voltage of the second node and a voltage of the third node, wherein the first sub-block is configured to maintain the voltage of the second node as the first logic level in response to the first clock signal, and wherein the second sub-block is configured to stabilize the gate signal in response to the voltage of the second node and a second clock signal.

2. The display device of claim 1, wherein the first sub-block includes:

a holding transistor including a gate electrode configured to receive the first clock signal, a first electrode configured to receive a first gate voltage from a first vertical voltage line, and a second electrode connected to the second node; and a first capacitor including a first electrode connected to the second node and a second electrode configured to receive a second gate voltage from a second vertical voltage line.

3. The display device of claim 1, wherein the second sub-block includes:

a first stabilizing transistor including a gate electrode connected to the second node, a first electrode configured to receive a second gate voltage from a second vertical voltage line, and a second electrode; and a second stabilizing transistor including a gate electrode configured to receive the second clock signal, a first electrode connected to the second electrode of the first stabilizing transistor, and a second electrode connected to the first node.

4. The display device of claim 1, wherein the third sub-block includes:

a first input transistor including a gate electrode configured to receive the first clock signal, a first electrode configured to receive the input signal, and a second electrode connected to the first node; and a second input transistor including a gate electrode connected to the first node, a first electrode is configured to receive the first clock signal, and a second electrode connected to the second node.

5. The display device of claim 1, wherein the fourth sub-block includes:

a reducing transistor including a gate electrode configured to receive a first gate voltage from a third voltage line, a first electrode connected to the first node, and a second electrode connected to the third node.

6. The display device of claim 1, wherein the fifth sub-block includes:

a first output transistor including a gate electrode connected to the third node, a first electrode configured to receive a second clock signal, and a second electrode connected to a first output terminal to which the gate signal is outputted;

a second capacitor including a first electrode connected to the third node and a second electrode connected to the first output terminal; and a second output transistor including a gate electrode connected to the second node, a first electrode configured to receive a second gate voltage from a fourth vertical voltage line, and a second electrode connected to the first output terminal.

7. The display device of claim 6, wherein the second clock signal is provided to the second sub-block and the fifth sub-block via different vertical clock lines.

8. The display device of claim 1, wherein each of the plurality of stages further includes a sixth sub-block, and wherein the sixth sub-block includes:

a third output transistor including a gate electrode connected to the third node, a first electrode configured to receive the second clock signal, and a second electrode connected to a second output terminal to which the gate signal is outputted, and a third capacitor including a first electrode connected to the third node and a second electrode connected to the second output terminal.

9. The display device of claim 1, wherein at least one of the plurality of gate lines is connected to a first pixel circuit and a second pixel circuit adjacent to the first pixel circuit in the second direction.

10. The display device of claim 1, wherein the at least one voltage line is connected to the plurality of pixel circuits.

11. A display device comprising:

a plurality of pixel circuits arranged in a plurality of pixel rows extending in a first direction and a plurality of pixel columns extending in a second direction crossing the first direction; and a gate driver including a plurality of stages, each of the plurality of stages configured to output a gate signal to each of a plurality of gate lines extending in the first direction, respectively, to provide the gate signal to a corresponding pixel circuit of the plurality of pixel circuits, wherein each of the plurality of stages are located between a first pixel column and a second pixel column different from the first pixel column of the plurality of pixel columns, and wherein each of the plurality of stages is disposed corresponding to at least two pixel rows of the plurality of pixel rows, the at least two pixel rows receiving different data signals.

12. The display device of claim 11, wherein the plurality of stages are configured to receive a clock signal from at least one vertical clock line extending in the second direction and receive a gate voltage from at least one voltage line extending in the second direction.

13. The display device of claim 11, wherein each of the plurality of stages is divided into a plurality of sub-blocks each of which includes at least one switch, and wherein at least one of the plurality of pixel circuits is located between two adjacent sub-blocks of the sub-blocks.

14. The display device of claim 11, wherein the gate driver includes:

a first gate driver configured to provide the gate signal to odd-number pixel rows; and a second gate driver configured to provide the gate signal to even-number pixel rows.

15. The display device of claim 14, wherein at least one of the pixel columns is located between the first gate driver and the second driver.

16. The display device of claim 11, wherein at least one of the plurality of gate lines is connected to both of a first pixel row and a second pixel row adjacent to the first pixel row.

17. A display device comprising:

a plurality of pixel circuits arranged in a plurality of pixel rows extending in a first direction and a plurality of pixel columns extending in a second direction crossing the first direction; and a gate driver including a plurality of stages configured to output a gate signal to each of a plurality of gate lines extending in the first direction, respectively, to provide the gate signal to a corresponding pixel circuit of the plurality of pixel circuits, wherein the plurality of stages are located between a first pixel column and a second pixel column different from the first pixel column of the pixel columns, and wherein at least one of the plurality of gate lines is connected to both of a first pixel row and a second pixel row adjacent to the first pixel row, the first pixel row and the second pixel row receiving different data signals.

18. The display device of claim 17, wherein a structure of a first pixel circuit included in the first pixel row is different from a structure of a second pixel circuit included in the second pixel row.

* * * * *